US006100482A

United States Patent [19]

Koma et al.

[11] Patent Number: 6,100,482

[45] Date of Patent: Aug. 8, 2000

[54] PUSHBUTTON SWITCH AND INPUT DEVICE USING THE SAME

[75] Inventors: Tetsuya Koma, Tsuruga; Mituo Aimi, Hirakata; Takefumi Inoue, Katano, all of Japan

[73] Assignee: Matsushita Electric Industrial Co., Ltd., Osaka, Japan

[21] Appl. No.: 09/335,188

[22] Filed: Jun. 17, 1999

[30] Foreign Application Priority Data

Jun. 18, 1998 [JP] Japan ..... 10-171059

[51] Int. Cl.[7] ..... H01H 13/70

[52] U.S. Cl. ..... 200/344

[58] Field of Search ..... 200/5 A, 517, 200/341, 344, 345; 400/490, 491, 491.2, 495, 495.1, 496

[56] References Cited

U.S. PATENT DOCUMENTS

| | | | |
|---|---|---|---|
| 4,453,063 | 6/1984 | Wanatowicz et al. | 200/340 |
| 4,771,146 | 9/1988 | Suzuki et la. | 200/340 |
| 4,918,270 | 4/1990 | Orrico | 200/302.2 |
| 5,117,076 | 5/1992 | Damitio | 200/344 |
| 5,350,244 | 9/1994 | Buttner | 400/496 |
| 5,367,135 | 11/1994 | Selby et al. | 200/345 |
| 5,597,067 | 1/1997 | Yoneyama | 200/344 |
| 5,668,358 | 9/1997 | Wolf et al. | 200/5 A |
| 5,819,914 | 10/1998 | Yoneyama | 200/344 |
| 5,823,325 | 10/1998 | Lin | 200/344 |
| 5,941,373 | 8/1999 | Cheng | 200/344 |

*Primary Examiner*—Michael Friedhofer
*Attorney, Agent, or Firm*—Wenderoth, Lind & Ponack, L.L.P.

[57] ABSTRACT

A low profile pushbutton switch having a predetermined stroke and which is free from looseness in both horizontal and vertical directions is realized, and an input device employing this pushbutton switch is obtained by embodying the following structure. A first side of a stabilizing member is engaged with a lower face of a key-top which depresses a switch contact via an elastic body and a link member. Both terminals of a second side of the stabilizing member open at its center section are held rotatably and slidably at a height range where the first side travels upon depressing of the key-top.

42 Claims, 8 Drawing Sheets

PUSHBUTTON SWITCH AND INPUT DEVICE USING THE SAME

FIELD OF THE INVENTION

The present invention relates to pushbutton switches employed in input devices of information equipment including word processors, portable computers and the like. The present invention also relates to input devices using the same pushbutton switches.

BACKGROUND OF THE INVENTION

In recent years, pushbutton switches employed in information equipment have been required to have a deeper stroke in order to obtain better tactile key operation, and to have a lower profile so that portable machines can be made thinner. In this market situation, how to realize a lower profile pushbutton switch that has a longer key-top, such as a space bar, than other ordinary key-tops is discussed.

A conventional pushbutton switch that has a longer key-top is described hereinafter with reference to the accompanying drawings. FIG. 10 is a front view, half in cross section, of the conventional pushbutton switch. FIG. 11 is a lateral cross section taken on line 11—11 of FIG. 10.

In FIG. 10, switch member 200 having switch contact 210 sandwiched by two films, on which conductive paste is printed, is disposed on metallic substrate 100. Elastic rubber dome 300 includes a protrusion 310, which depresses switch contact 210, at an upper inside portion thereof. Cylindrical stem 410 is provided underneath and at the center of key-top 400. Stem 410 pushes against outer wall 320, which is donut-shaped as viewed from above, near a top of the rubber dome 300, and is pushed upwardly by elasticity of rubber dome 300.

Two sets of resin-molded link members 500, each set comprising two members 500 crossing each other at their center and fixed at the crossing point and forming an "X" shape, are disposed so that the two sets sandwich the rubber dome 300. Resin-molded fixture 600 is placed on an upper face of switch member 200. An upper end 510 of link member 500 is engaged rotatably with stopper 420 provided on a lower face of key-top 400, while a lower end 520 is rotatably and slidably engaged in recess 610 of fixture 600. These engagements are symmetrically constructed with regard to rubber dome 300, the same engagements discussed above are thus provided on the left half of FIG. 10.

Cylindrical depending bosses 430 are provided on both sides on the lower face of key-top 400, and an outer wall of each boss 430 can slide with regard to an inner wall of a corresponding guide hole part 620 protruding from the fixture 600. The hole 620 is oval in plan view.

FIG. 12 shows a perspective view of a stabilizing member 700 formed by bending a hard metal wire. Stabilizing member 700 has a rectangular shape with open at the center.

Another side 710 of the stabilizing member 700 is engaged rotatably with two stoppers 440 disposed on the lower face of the key-top 400 near both ends of this side 710. The open side opposite the to side 710 is held slidably between an upper face of fixture 600 and two hook-shaped protrusions 630 at terminal portions 720. These engagements of stabilizing member 700 are symmetrically arranged with regard to rubber dome 300.

An operation of the conventional pushbutton switch having the construction discussed above is described hereinafter.

When a user depresses key-top 400 with a fingertip, the upper end 510 of link member 500, which is engaged with the stopper 420, is rotated. At the same time, the lower end 520 held in the recess 610 of fixture 600 is rotated and slid. Stem 410 thus depresses the outer wall 320 of rubber dome 300, whereby, rubber dome 300 is deflected, and then the protrusion 310 activates switch contact 210.

When the user releases the pressure from key-top 400, the rubber dome 300 returns to its natural orientation, and moves the link member 500 and the key-top 400 to their upper positions. Switch contact 210 then returns to the off-status shown in FIG. 10.

In this operation, the outer circumference of boss 430 shown in FIG. 11 slidably contacts the inner wall of guide hole 620 across the shorter diameter of its oval shape, and slides up and down with regard to the inner wall in response to the up and down travelling of key-top 400.

Regarding the stabilizing member 700, when the side 710 held by stopper 440 is rotated, both terminals 720 of the side opposite to the side 710 slide in a horizontal direction between protrusions 630 and the upper face of fixture 600.

In other words, the looseness of key-top 400 in a rotating direction with regard to rubber dome 300 and in a horizontal direction is prevented by the engagement of the cylindrical boss 430 in the oval guide hole 620. The looseness in a vertical direction on both sides of key-top 400 is prevented by stabilizing member 700.

The conventional pushbutton switch having a longer key-top, however, cannot be free from looseness or imbalance of heights on both sides of key-top 400, even with all the preventive measures discussed above, because of gaps in holders of both terminals 720 and warping of key-top 400.

In order to prevent boss 430 from coming out of guide hole 620, some height for engagement is desirably prepared between the boss 430 and the hole 620, which prevents heights of both of the boss and guide hole from being further lowered. As a result, the conventional pushbutton switch is limited to its original height.

Regarding a deeper stroke of the pushbutton switch, it requires greater heights of boss 430 and guide hole 620.

SUMMARY OF THE INVENTION

The present invention addresses the problems discussed above and aims to provide a low profile pushbutton switch having a predetermined stroke and being free from looseness in both horizontal and vertical directions.

The pushbutton switch of the present invention comprises the following elements:

(a) a substrate;

(b) a switch member having a switch contact and disposed on the substrate;

(c) a fixture having a protrusion and disposed on the switch member;

(d) an elastic body having a protrusion for depressing the switch contact and restoring force, and disposed over the switch contact;

(e) a key-top disposed on the elastic body for depressing the switch contact through the elastic body upon being depressed by a user;

(f) a link member, having an upper end engaged with the key-top and a lower end engaged with the fixture, for holding the key-top in a full-travel manner; and (g) a stabilizing member having a first side and an opposite second side of which center section is opened and thus two terminals are formed. This stabilizing member is fit into the pushbutton switch in the following manner:

(g-1) the first side of the stabilizing member is rotatably engaged with the key-top; and (g-2) both of the terminals of the second side of the stabilizing member are rotatably and slidably held by protrusions for movement within a height range where the first side travels when the key-top is depressed.

This construction allows both terminals on the second side of the stabilizing member to slide in a shorter distance, so that looseness of the key-top in both horizontal and vertical directions is restrained. This construction thus can save the conventional bosses provided on the lower face of the key-top and guide holes provided on the fixture, restrain looseness of the key-top, prepare a predetermined stroke and realize a low profile pushbutton switch. A thinner input device employing this low profile pushbutton switch can also be realized.

DETAILED DESCRIPTION OF THE INVENTION

Exemplary embodiments of the present invention are described hereinafter with reference to the accompanying drawings.

Exemplary Embodiment 1

Figure 1:
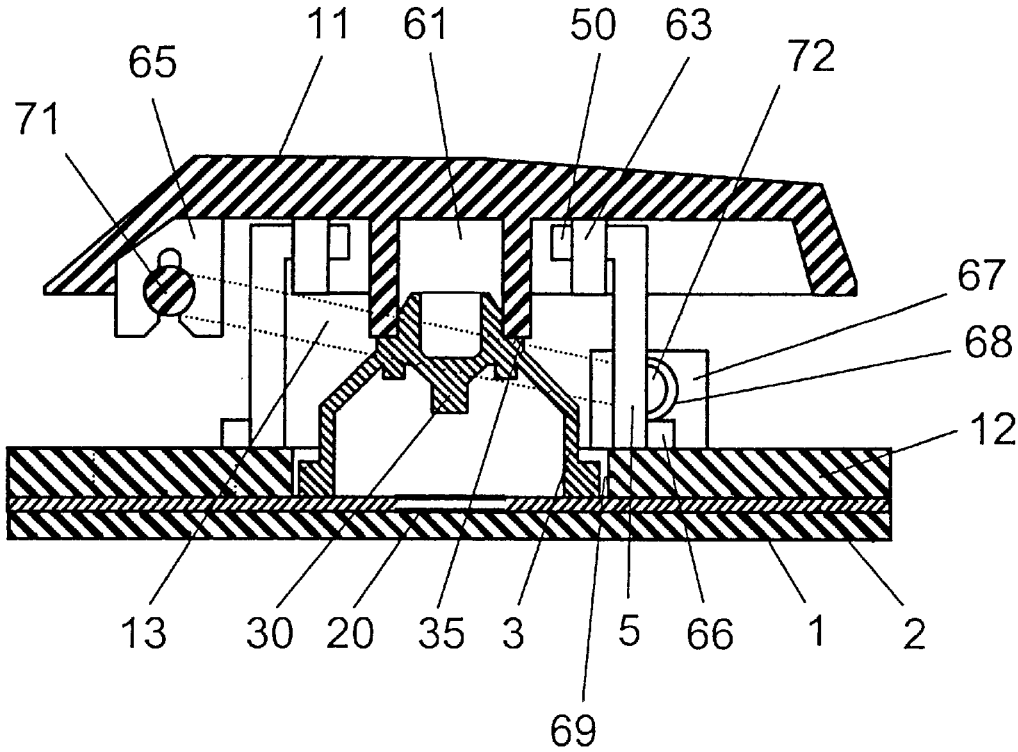
FIG. 1 is a lateral cross section of a pushbutton switch in accordance with a first exemplary embodiment of the present invention.
Figure 2:
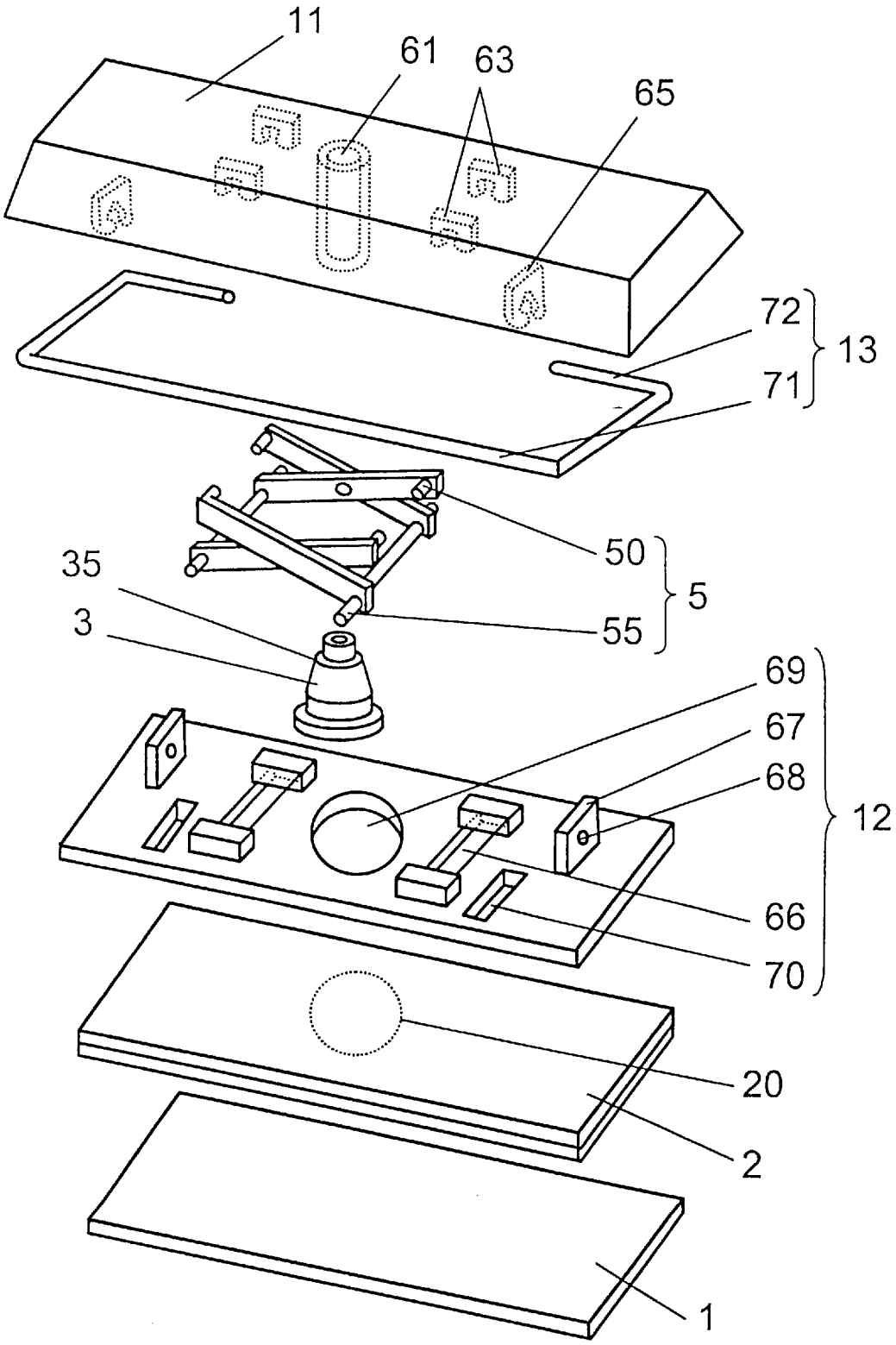
FIG. 2 shows a perspective exploded view of the pushbutton switch shown in FIG. 1.

FIG. 1 is a lateral cross section of a pushbutton switch in accordance with the first exemplary embodiment of the present invention, and FIG. 2 shows a perspective exploded view of the pushbutton switch shown in FIG. 1.

In both FIG. 1 and FIG. 2, a base member includes switch member 2 disposed on a metallic substrate 1, and a resin-molded fixture 12 mounted to an upper face of switch member 2. Switch member 2 comprises two films bonded to each other and a switch contact 20 in between. An elastic body is, for example, a rubber dome 3, and has a depending protrusion 30 at upper inside portion thereof. Protrusion 30 is used for depressing switch contact 20. Rubber dome 3 is placed on switch member 2 through a round hole 69 formed in fixture 12 so that protrusion 30 can be located above switch contact 20.

An elongated key-top 11, e.g. a space bar, is provided with a cylindrical stem 61 at the center of its lower face. Stem 61 presses against an outer wall 35, which is donut-shaped when viewed from top, near the above and is located of rubber dome 3, and is moved upwardly by the elasticity of rubber dome 3.

Two sets of link members 5 made of molded-resin are disposed at both sides of rubber dome 3 so that the two sets sandwich dome 3. As shown in FIG. 2, one set of link members 5 comprises two link members 5 crossing each other at their center and pivotally connected at the crossing point.

Four upper ends 50 of link members 5 are engaged rotatably with respective stoppers 63 disposed on the lower face of key-top 11, and four lower ends 55 of link members 5 are engaged rotatably and slidably with respective recesses 66 provided on fixture 12. These engagements are symmetrically constructed with regard to rubber dome 3 under key-top 11.

Further, fixture 12 is provided with quadrangle holes 70 in order to prevent stoppers 65 provided underneath key-top 11 from hitting fixture 12.

A stabilizing member 13 is detailed hereinafter. It is formed by squaring a hard metallic wire. The quadrangle formed by the metallic wire has a first side 71 and a second side. The second side is open at its center and thus two terminals 72 are formed. Since key-top 11 has longer sides than other regular key-tops, the first side 71 and the second side of the stabilizing member 13 are desirably longer than the other two sides.

Sections near both of the ends of first side 71 are engaged rotatably with respective stoppers 65 provided on the lower face of key-top 11. Both terminals 72 of the second side are held rotatably and slidably by being extended through respective holes 68 punched in protrusions 67 formed on an upper face of fixture 12. Each of the holes 68 is shaped as an oval, and its longer diameter, slightly longer than the other one, crosses the longitudinal direction of key-top 11 at right angles. Each hole 68 is located at an approximate center of a travelling range of the first side 71, responsive to depression of the key-top 11.

An operation of a pushbutton switch having the construction discussed above is described hereinafter.

Figure 3:
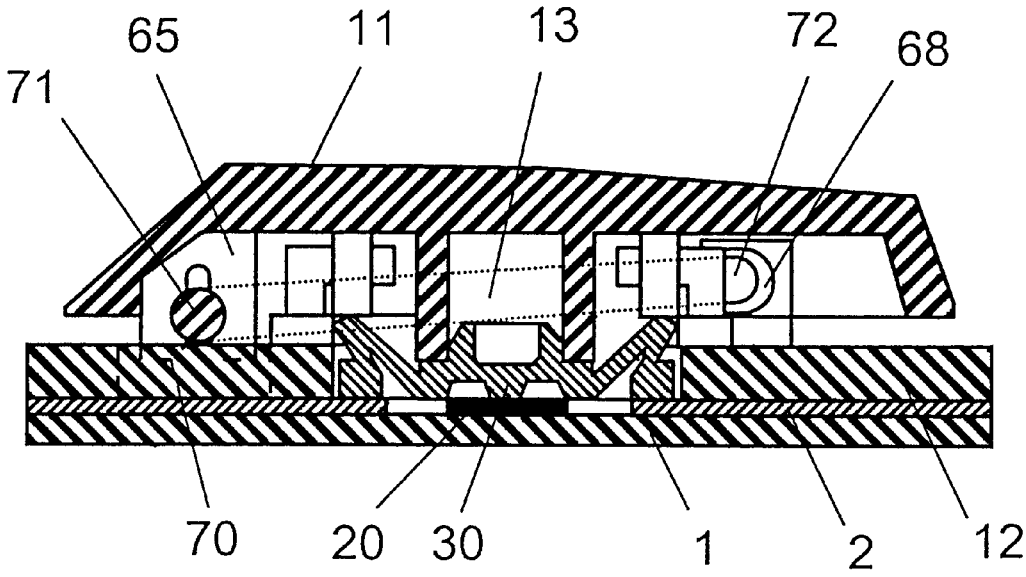
FIG. 3 is a lateral cross section illustrating an operation of the same switch shown in FIG. 1.

When a user depresses key-top 11 with a fingertip, upper ends 50 of link members 5, which are engaged with stoppers 63, are rotated. At the same time, lower ends 55 held atop the upper face of switch member 2 in recesses 66 of fixture 12 are rotated and slid. Stem 61 depending from the key-top center thus depresses outer wall 35 of rubber dome 3, rubber dome 3 is deflected as shown in FIG. 3, and then protrusion 30 activates switch contact 20.

When the user releases the pressure from key-top 11, rubber dome 3 returns to its natural orientation, and moves link members 5 and key-top 11 to their raised positions. Switch contact 20 then returns to an off-status.

Movements of stabilizing member 13, responsive to this depressing and releasing of the key-top 11, is detailed hereinafter with reference to FIG. 1 and FIG. 3.

In FIG. 1, when key-top 11 is depressed, stabilizing member 13 travels downwardly by rotating side 71 engaged with stopper 65 of key-top 11. At the same time, in FIG. 1, both of the terminals 72 held by holes 68 slightly travel to the right by rotating in holes 68 and so that return to the left, then the switch contact is activated as shown in FIG. 3.

When the depressing force imposed on key-top 11 is removed, key-top 11 is pushed up by the restoring force of rubber dome 3, and stabilizing member 13 moves the other way around and raises key-top 11 smoothly, so that the switch contact returns to its off-status as shown in FIG. 1.

Figure 11:
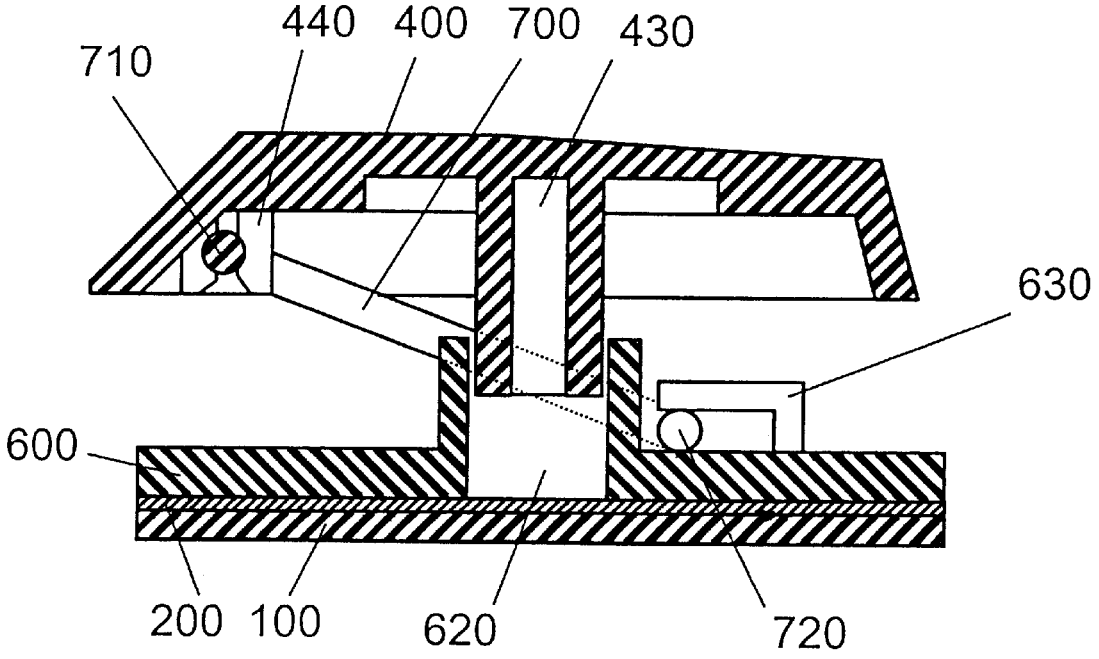
FIG. 11 PRIOR ART
FIG. 11 is a lateral cross section of the conventional pushbutton switch taken on lines 11—11 of FIG. 10.
Figure 12:
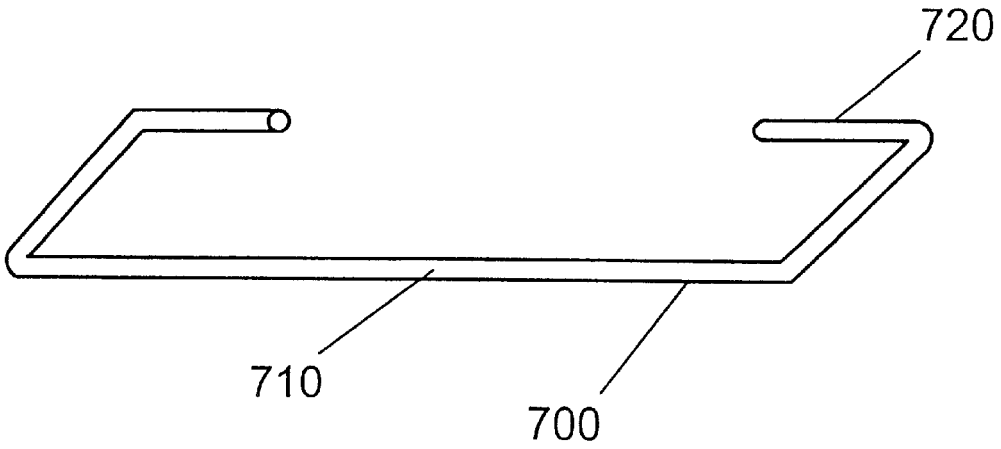
FIG. 12 PRIOR ART
FIG. 12 is a perspective view of a stabilizing member of the conventional pushbutton switch.

As discussed above, according to the first exemplary embodiment, sliding distance by both terminals 72 in a horizontal direction can be reduced comparing with that of the prior art shown in FIG. 11. In other words, stabilizing member 13 restrains not only vertical looseness at both sides of key-top 11 but also horizontal looseness.

This embodiment can thus restrain looseness in both vertical and horizontal directions, and also save the conventional bosses depending from the key-top as well as guide holes on the fixture. As a result, a predetermined stroke can be provided in a low profile pushbutton switch. When these pushbutton switches are employed in an input device, the input device can be thinner and have a deep enough stroke with little looseness.

Figure 4:
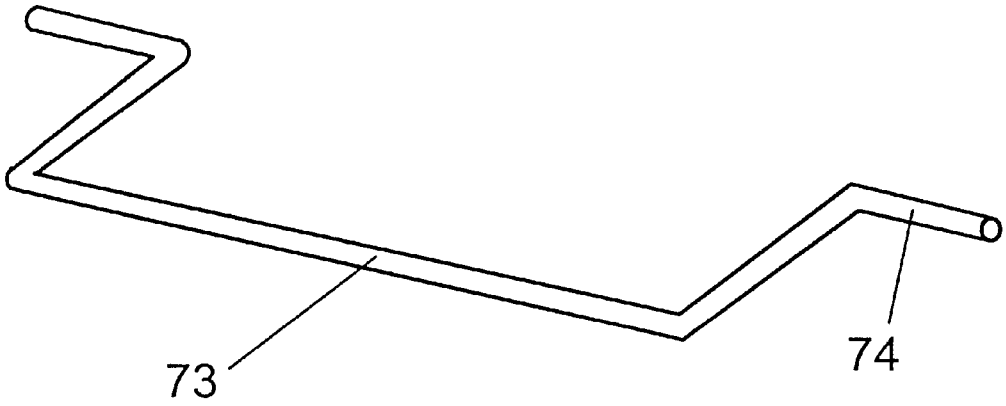
FIG. 4 shows a perspective outlook of another form of a stabilizing member of the same pushbutton switch.

The shape of stabilizing member 13 is described as a quadrangle where both of the terminals of the open side are bent inside. However, another form as shown in FIG. 4 can produce the same effect, i.e. first side 73 measures slightly shorter and both terminals 74 of a second side are bent outwardly.

Exemplary Embodiment 2

Figure 5:
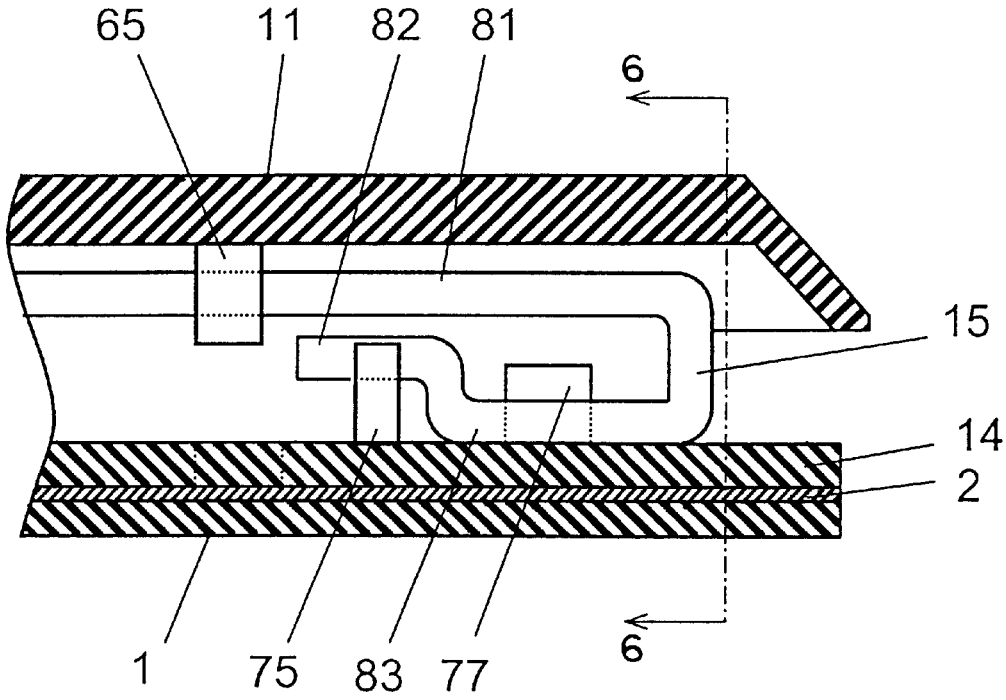
FIG. 5 is a front cross section showing a right end of a pushbutton switch in accordance with a second exemplary embodiment of the present invention.
Figure 6:
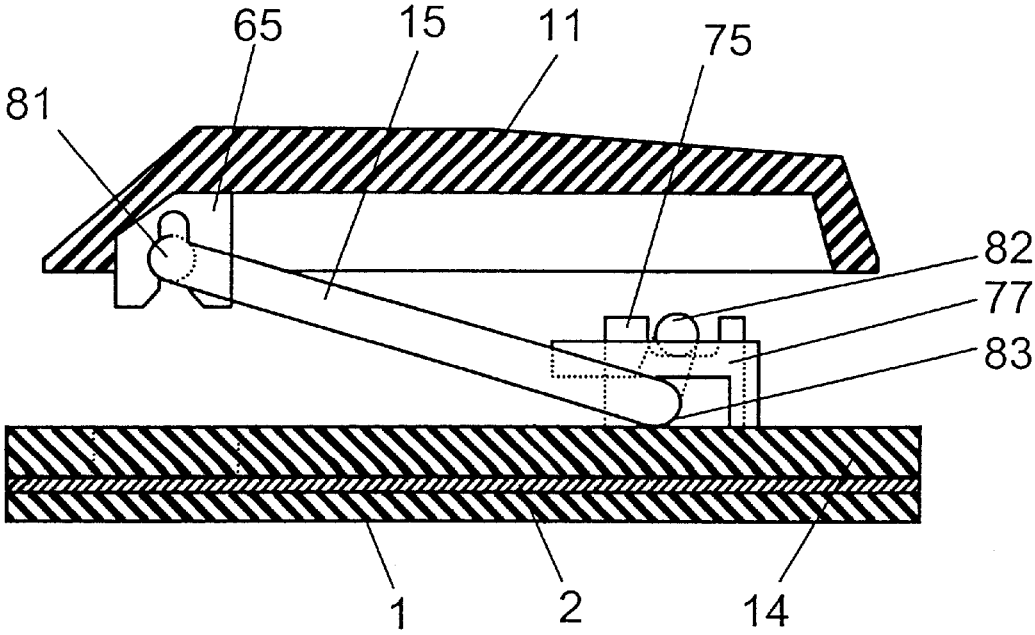
FIG. 6 is a lateral cross section taken on line 6—6 of FIG. 5.
Figure 7:
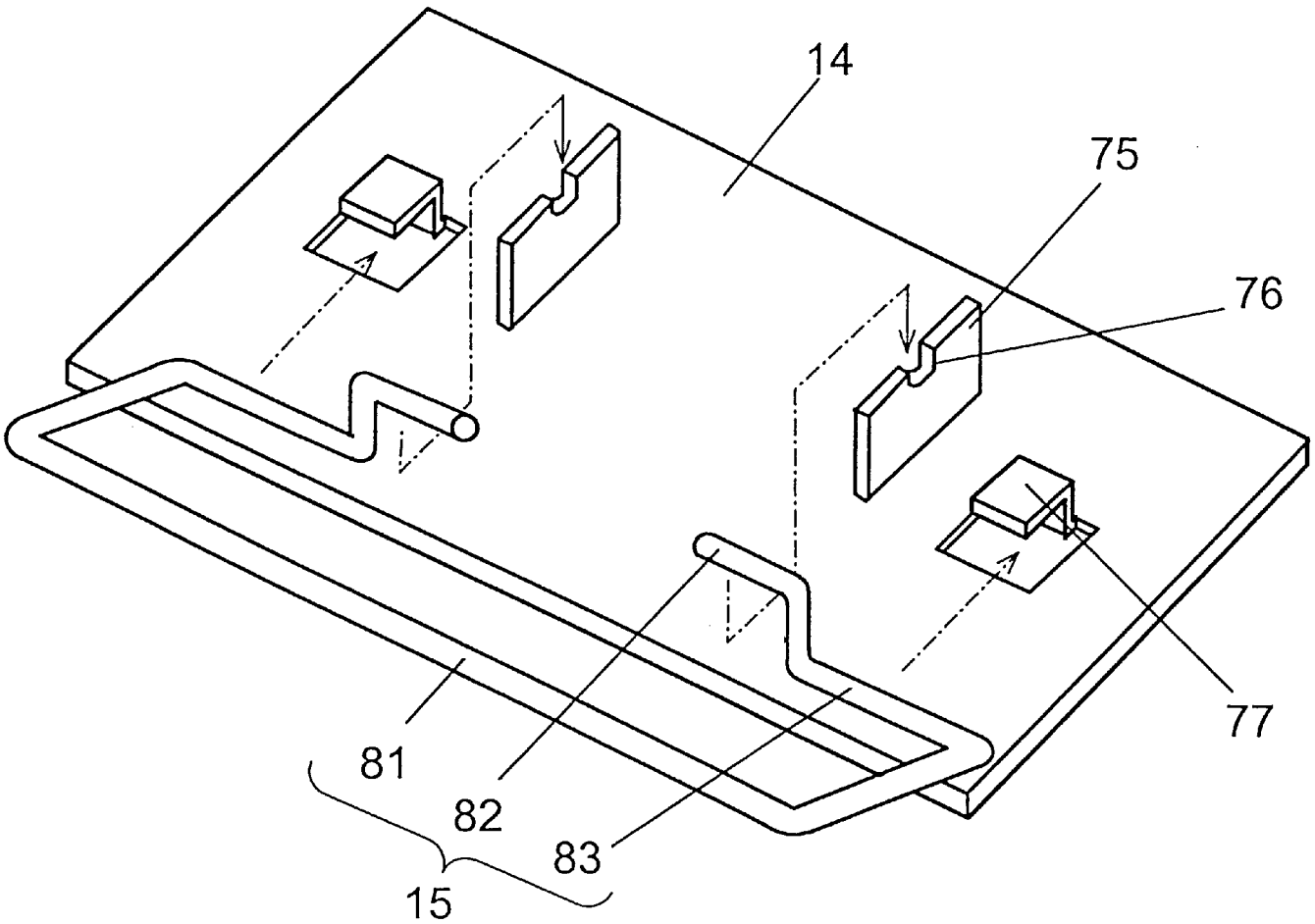
FIG. 7 is a perspective exploded view of an essential part of the same pushbutton switch shown in FIG. 5.

FIG. 5 is a front cross section showing a right end of a pushbutton switch in accordance with the second exemplary embodiment of the present invention, and FIG. 6 is a lateral cross section taken on line 6—6 of FIG. 5. The switch section including the rubber dome is omitted in FIG. 6. FIG. 7 is a perspective exploded view of an essential part of the same pushbutton switch shown in FIG. 5.

The pushbutton switch in accordance with the second exemplary embodiment differs only in an engagement structure between a fixture 14 and a stabilizing member 15 from that of the first exemplary embodiment, and the other features remain the same.

First side 81 of stabilizing member 15 is engaged rotatably with two stoppers 65 provided on a lower face of key-top 11 at the sections near both ends of side 81. Both terminals 82 of the second side, i.e. the open side of stabilizing member 15, are crank-shaped and form approximate right angles with regard to a quadrangle face as shown in FIG. 7. Both terminals 82 are held rotatably and slidably in U-shaped grooves 76 formed on respective upper ends of two protrusions 75 provided on fixture 14. Further, regular sections 83 of the second side are fit slidably into hook-shaped guide sections 77 provided on fixture 14, so that sections 83 hardly move upwardly.

U-shaped grooves 76 formed on the upper ends of protrusions 75 are described here. Each groove 76 is provided at a height so that the centers of both terminals 82 are located at an approximate center of a travelling range of side 81 responsive to depressing of the key-top 11. Further, the depth of groove 76 is greater than the center of terminal 82 but not greater than outer diameter of terminal 82. The height of protrusion 75 is thus limited to a lower height than that of exemplary embodiment 1.

In the pushbutton having the construction discussed above, the movement of stabilizing member 15 responsive to depressing of the key-top 11 against the elasticity of a rubber dome (not shown in FIG. 6, but the same dome 3 shown in FIG. 1) is described hereinafter.

Depressing of the key-top 11 entails side 81 engaged with stopper 65 traveling downwardly by rotating. Both terminals 82 situated in grooves 76 slightly move to the right in FIG. 6, then return to the left. Regular sections 83 held by guide sections 77 of fixture 14 slightly move to the right in FIG. 6. Key-top 11 thus lowers smoothly, thereby activating the pushbutton switch.

Then, the depressing force imposed on key-top 11 is removed, and the rubber dome pushes up key-top 11 by its restoring force. At the same time, stabilizing member 15 moves the other way around to raise key-top 11 smoothly. As a result, the pushbutton switch returns to its off-status.

As discussed above, according to the second exemplary embodiment, looseness of key-top 11 in both horizontal and vertical directions can be restrained without the conventional bosses depending from the lower face of key-top or guide holes provided on the fixture. This is the same advantage obtained in the first exemplary embodiment. Further, the height of protrusion 75 on fixture 14 can be lowered, which can widen the space below key-top 11. The pushbutton switch thus can be a lower profile.

Figure 8:
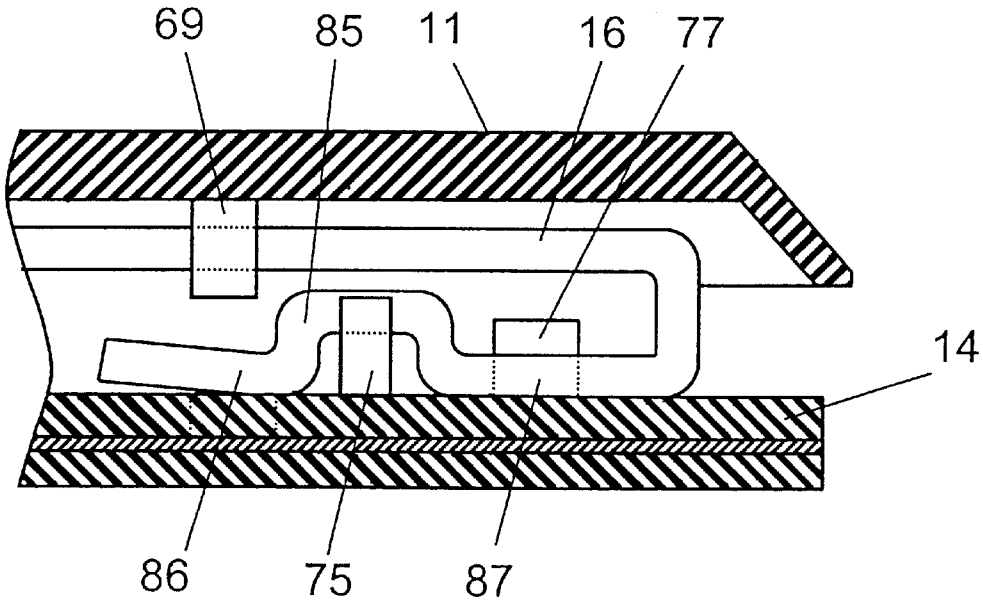
FIG. 8 is a front cross section showing a right end of the same pushbutton switch using another form of the stabilizing member in accordance with the second exemplary embodiment of the present invention.

Instead of using stabilizing member 15 shown in FIG. 5, another stabilizing member 16, having a crank shape on both of the terminals as shown in FIG. 8, can be employed. In stabilizing member 16, downwardly bent section 86, extended from section 85 situated in groove 76, is urged to the upper face of fixture 14. Section 87 opposite to bent section 86 is engaged with hook-shaped guide section 77.

This construction can eliminate a gap between section 87 and the lower face of guide section 77 thanks to the elasticity of bent section 86 to the upper face of fixture 14. As a result, operation noises due to subtle looseness can be restrained.

Exemplary Embodiment 3

Figure 9:
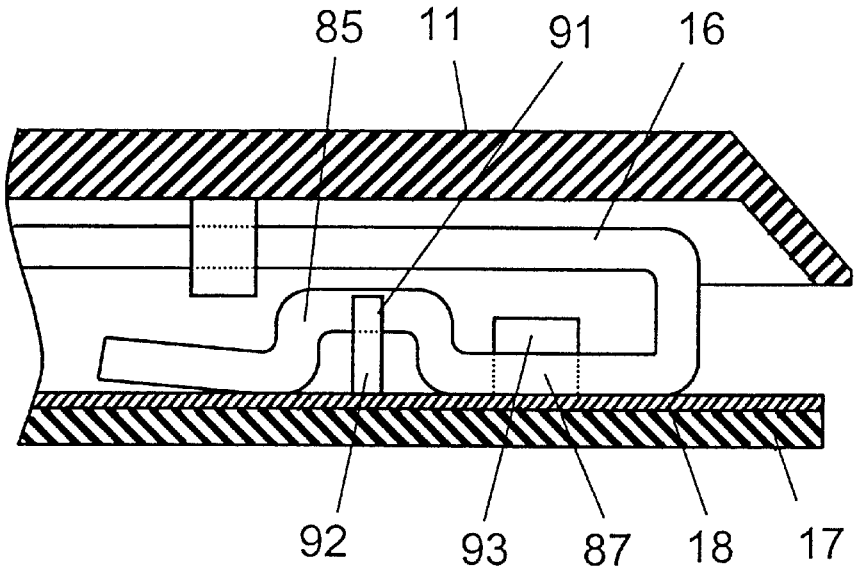
FIG. 9 is a front cross section showing a right end of a pushbutton switch in accordance with a third exemplary embodiment of the present invention.
Figure 10:
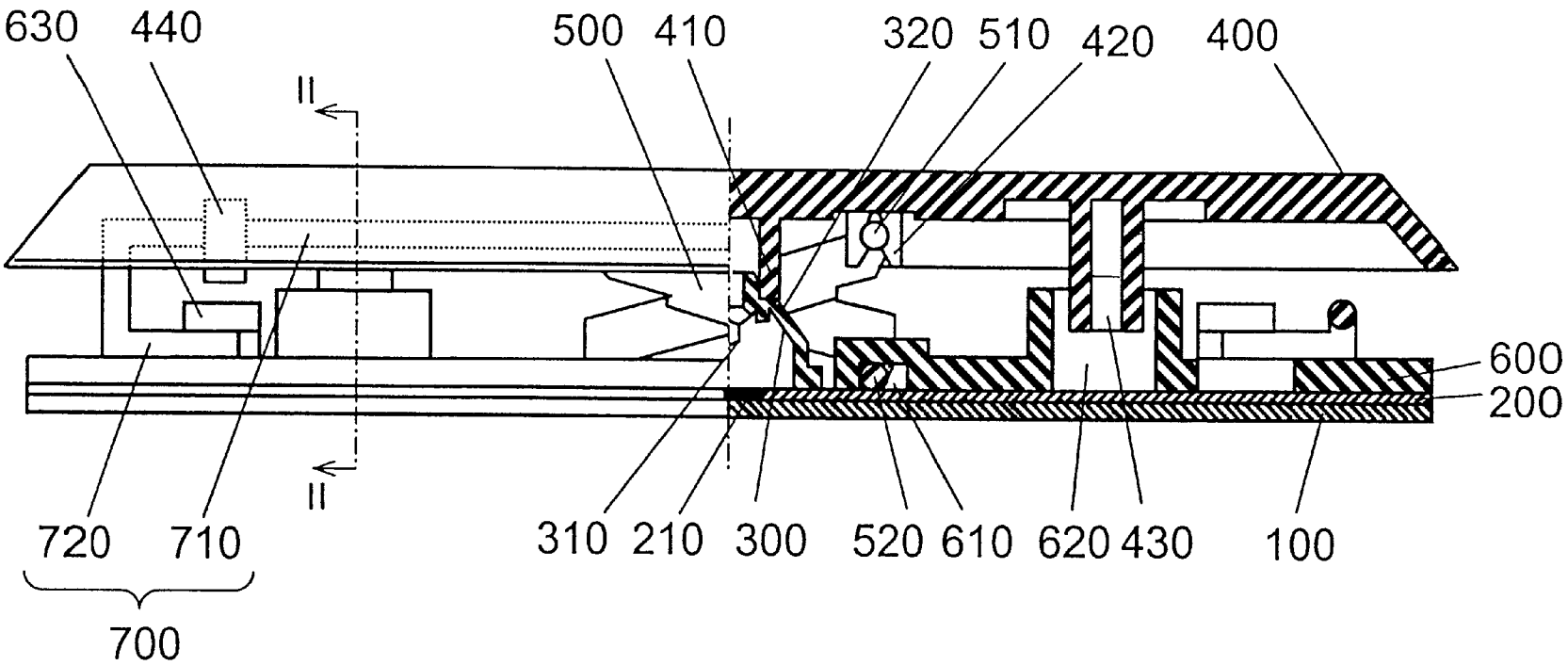
FIG. 10 PRIOR ART
FIG. 10 is a front view, half in cross section, of a conventional pushbutton switch.

FIG. 9 is a front cross section showing a right end of a pushbutton switch in accordance with the third exemplary embodiment of the present invention. This pushbutton switch can advantageously eliminate the fixture from that of the second exemplary embodiment.

In FIG. 9, metallic substrate 17 is punched and bent to unitarily form protrusions 92, guide sections 93 and stoppers (not shown) for engaging a lower end of a link member. These elements protrude upwardly through holes (not shown) punched in switch member 18 disposed on an upper face of substrate 17. On the upper end of protrusion 92, a U-shaped groove 91 is formed. Groove 91 holds a second side, i.e. the crank-shaped terminal 85, and guide section 93 engages section 87 of stabilizing member 16.

According to the third exemplary embodiment, fixture 14, shown in FIG. 8 and used in the second exemplary embodiment, can be saved, so that the material cost and assembly cost can be reduced, and further, the space below key-top 11 can be further widened. As a result, an even lower profile pushbutton switch can be realized.

The construction of this third exemplary embodiment is described by comparing it with the second exemplary embodiment; however, this advantage can be also applicable to the first exemplary embodiment.

As discussed above, according to the present invention, the lower profile pushbutton switch can be realized, where the looseness of the key-top is restrained, and a predetermined stroke is prepared, through the following advantageous structure.

(a) The first side of the stabilizing member is engaged rotatably with the lower face of the key-top. The lower face of the key-top eventually depresses the switch contact via the elastic body and link member.

(b) Both of the terminals of the open second side of the stabilizing member are held rotatably and slidably at the height within a travelling range of the first side responsive to depressing of the key-top.

What is claimed is:

1. A pushbutton switch comprising:

a base member including protrusions and a switch member having a switch contact;

an elastic body having restoring force and a protrusion for depressing the switch contact, and disposed over the switch contact;

a key-top disposed on said elastic body and which, upon being depressed, depresses the switch contact through said elastic body;

a link member, having an upper end engaged with said key-top and a lower end engaged with said base member, holding said key-top in a full-travel manner; and a stabilizing member having a first side and an opposite second side, said second side having a central opening and two terminals on either side of said central opening;

wherein said first side of said stabilizing member is rotatably engaged with said key-top;

wherein both of said terminals of said second side of said stabilizing member are rotatably and slidably held by said protrusions of said base member for movement within a height range where said first side travels when said key-top is depressed; and wherein both of the terminals of the second side are situated in U-shaped grooves provided on upper ends of said protrusions of said base member, and sections of both of the terminals are fit into guide sections provided on an upper face of said base member.

2. The pushbutton switch as defined in claim 1 wherein said terminals of said second side of said stabilizing member extend outwardly in opposite directions away from said central opening of said second side.

3. The pushbutton switch as defined in claim 2 wherein both of the terminals of the second side are held by said protrusions of said base member at a center of a height range where the first side travels.

4. A pushbutton switch as defined in claim 2, wherein said base member further includes a substrate, and said switch member is disposed on said substrate.

5. A pushbutton switch as defined in claim 4, wherein said base member further includes a fixture disposed on said switch member; and said protrusions of said base member are formed as parts of said fixture.

6. A pushbutton switch as defined in claim 4, wherein said protrusions of said base member are formed as parts of said substrate; and said guide sections are formed as parts of said substrate.

7. The pushbutton switch as defined in claim 1 wherein both of the terminals of the second side are held by said protrusions of said base member at a center of a height range where the first side travels.

8. A pushbutton switch as defined in claim 7, wherein said base member further includes a substrate, and said switch member is disposed on said substrate.

9. A pushbutton switch as defined in claim 8, wherein said base member further includes a fixture disposed on said switch member; and said protrusions of said base member are formed as parts of said fixture.

10. A pushbutton switch as defined in claim 8, wherein said protrusions of said base member are formed as parts of said substrate; and said guide sections are formed as parts of said substrate.

11. The pushbutton switch as defined in claim 7 wherein said terminals of said second side of said stabilizing member extend outwardly in opposite directions away from said central opening of said second side.

12. A pushbutton switch as defined in claim 11, wherein said base member further includes a substrate, and said switch member is disposed on said substrate.

13. A pushbutton switch as defined in claim 12, wherein said base member further includes a fixture disposed on said switch member; and said protrusions of said base member are formed as parts of said fixture.

14. A pushbutton switch as defined in claim 12, wherein said protrusions of said base member are formed as parts of said substrate; and said guide sections are formed as parts of said substrate.

15. The pushbutton switch as defined in claim 1, wherein middle parts of crank-shaped sections formed on both of the terminals of the second side are situated in the U-shaped grooves so that heights of the middle parts are within a range where the first side travels when said key-top is depressed, wherein said sections of said terminals which are fit into said guide sections comprise regular sections and are slidably fit into said guide sections, and wherein sections of said second side disposed, respectively, on sides of said U-shaped groove opposite the regular sections are urged to the upper face of said base member.

16. A pushbutton switch as defined in claim 15, wherein said base member further includes a substrate, and said switch member is disposed on said substrate.

17. A pushbutton switch as defined in claim 16, wherein said base member further includes a fixture disposed on said switch member; and said protrusions of said base member are formed as parts of said fixture.

18. A pushbutton switch as defined in claim 16, wherein said protrusions of said base member are formed as parts of said substrate; and said guide sections are formed as parts of said substrate.

19. A pushbutton switch as defined in claim 1, wherein said base member further includes a substrate, and said switch member is disposed on said substrate.

20. A pushbutton switch as defined in claim 19, wherein said base member further includes a fixture disposed on said switch member; and said protrusions of said base member are formed as parts of said fixture.

21. A pushbutton switch as defined in claim 19, wherein said protrusions of said base member are formed as parts of said substrate; and said guide sections are formed as parts of said substrate.

22. An input device employing a pushbutton switch, said switch comprising:

a base member including protrusions and a switch member having a switch contact;

an elastic body having restoring force and a protrusion for depressing the switch contact, and disposed over the switch contact;

a key-top disposed on said elastic boy and which, upon being depressed, depresses the switch contact through said elastic body;

a link member having an upper end engaged with said key-top and a lower end engaged with said base member, holding said key-top in a full-travel manner; and a stabilizing member having a first side and an opposite second side, said second side having a central opening and two terminals on either side of said central opening;

wherein said first side of said stabilizing member is rotatably engaged with said key-top;

wherein both of said terminals of said second side of said stabilizing member are rotatable and slidably held by said protrusions of said base member for movement within a height range where said first side moves when said key-top is depressed; and wherein both of the terminals of the second side of said pushbutton switch are situated in U-shaped grooves provided on upper ends of said protrusions of said base member, and sections of both of the terminals are fit into guide sections provided on an upper face of said base member.

23. The input device as defined in claim 22 wherein said terminals of said second side of said stabilizing member extend outwardly in opposite directions away from said central opening of said second side.

24. The input device as defined in claim 23 wherein both of the terminals of the second side of said stabilizing member are held by said protrusions of said base member at a center of a height range where the first side travels.

25. The input device as defined in claim 23, wherein said base member further includes a substrate, and said switch member is disposed on said substrate.

26. The input device as defined in claim 25, wherein said base member further includes a fixture disposed on said switch member; and said protrusions of said base member are formed as parts of said fixture.

27. The input device as defined in claim 25, wherein said protrusions of said base member are formed as parts of said substrate; and said guide sections are formed as parts of said substrate.

28. The input device as defined in claim 22 wherein both of the terminals of the second side of said stabilizing member are held by said protrusions of said base member at a center of a height range where the first side travels.

29. The input device as defined in claim 28, wherein said base member further includes a substrate, and said switch member is disposed on said substrate.

30. The input device as defined in claim 29, wherein said base member further includes a fixture disposed on said switch member; and said protrusions of said base member are formed as parts of said fixture.

31. The input device as defined in claim 29, wherein said protrusions of said base member are formed as parts of said substrate; and said guide sections are formed as parts of said substrate.

32. The input device as defined in claim 28 wherein said terminals of said second side of said stabilizing member extend outwardly in opposite directions away from said central opening of said second side.

33. The input device as defined in claim 32, wherein said base member further includes a substrate, and said switch member is disposed on said substrate.

34. The input device as defined in claim 33, wherein said base member further includes a fixture disposed on said switch member; and said protrusions of said base member are formed as parts of said fixture.

35. The input device as defined in claim 33, wherein said protrusions of said base member are formed as parts of said substrate; and said guide sections are formed as parts of said substrate.

36. The input device as defined in claim 22, wherein middle parts of crank-shaped sections formed on both of the terminals of the second side are situated in the U-shaped grooves so that heights of the middle parts are within a range where the first side travels when said key-top is depressed, wherein said sections of said terminals which are fit into said guide sections comprise regular sections and are slidably fit into said guide sections, and wherein sections of said second side disposed, respectively, on sides of said U-shaped grooves opposite the regular sections are urged to the upper face of said base member.

37. The input device as defined in claim 36, wherein said base member further includes a substrate, and said switch member is disposed on said substrate.

38. The input device as defined in claim 37, wherein said base member further includes a fixture disposed on said switch member; and said protrusions of said base member are formed as parts of said fixture.

39. The input device as defined in claim 37, wherein said protrusions of said base member are formed as parts of said substrate; and said guide sections are formed as parts of said substrate.

40. The input device as defined in claim 22, wherein said base member further includes a substrate, and said switch member is disposed on said substrate.

41. The input device as defined in claim 40, wherein said base member further includes a fixture disposed on said switch member; and said protrusions of said base member are formed as parts of said fixture.

42. The input device as defined in claim 40, wherein said protrusions of said base member are formed as parts of said substrate; and said guide sections are formed as parts of said substrate.

* * * * *